United States Patent [19]

Ackman

[11] Patent Number: 4,804,973

[45] Date of Patent: Feb. 14, 1989

[54] HEAVY DUTY MOUNTING BASE

[76] Inventor: Gregory Ackman, 17 Sloane St., Marrickville 2204, Australia

[21] Appl. No.: 902,560

[22] Filed: Sep. 2, 1986

[30] Foreign Application Priority Data

Sep. 3, 1985 [AU] Australia ..... PH2268

[51] Int. Cl.[4] ..... H01Q 1/12

[52] U.S. Cl. ..... 343/888; 343/711; 343/713; 343/906

[58] Field of Search ..... 343/711–715, 343/872, 873, 888, 900, 906

[56] References Cited

U.S. PATENT DOCUMENTS

| | | | |
|---|---|---|---|
| 3,408,652 | 10/1968 | Allisbaugh | 343/906 |
| 4,066,324 | 1/1978 | Stephens | 343/715 |
| 4,152,704 | 5/1979 | Burg | 343/900 |
| 4,255,735 | 3/1981 | Liautaud | 343/888 |
| 4,625,213 | 11/1986 | Horn | 343/715 |

FOREIGN PATENT DOCUMENTS

| | | | |
|---|---|---|---|
| 0761102 | 11/1956 | United Kingdom | 343/872 |
| 0921584 | 3/1963 | United Kingdom | 343/888 |

*Primary Examiner*—William L. Sikes
*Assistant Examiner*—Doris J. Johnson
*Attorney, Agent, or Firm*—Townsend and Townsend

[57] ABSTRACT

A heavy duty aerial mounting base which is structurally resilient and electrically insulated. There is a solid inner core and a weathershielding outer core integrally formed with the inner core. The inner and outer cores are concentric and are formed with a space between them. The outer core tapers inwardly and upwardly at one end until it meets the inner core. There are reinforcing ribs in the space between the inner and outer cores.

7 Claims, 4 Drawing Sheets

HEAVY DUTY MOUNTING BASE

The present invention relates to an improved heavy duty aerial mounting base for use, in particular though not exclusively, on heavy vehicles where the motion loadings and vibrations impose significantly high stresses on mounting bases for aerials.

A great variety of aerial mounting bases are known, however, few of these are suitable in situations where the mounting base would be subjected to large stresses from the actions of heavy vehicles. The mounting bases can also be subjected to wind generated bending stresses particularly when high aerials are used. This can lead to complete failure of a mounting base.

One of the known mounting bases on the market has been used for heavy duty applications, however, this has certain shortcomings from a manufacturing and behavioural point of view, which the present invention seeks to overcome.

In heavy duty applications where an aerial mounting base is subject to bending, torsional and shear stresses, the mounting base must be comprised of resilient materials which can withstand constant cyclic stresses.

The aforesaid prior art heavy duty mounting bases are made of aluminium or stainless steel and are comprised of a multiplicity of components, including a housing in which the electrical connections are located, an insulating weather seal and a base plate detachable from the housing. Due to the detachability of the various components and the resultant discontinuities in the base structure, which require sealing, it has been found that these heavy duty bases have allowed water ingress and hence corrosion of essential connecting wires, in particular, at the connection points. Because the metallic bases are not electrically inert, problems can be created with signals as a result of the weathering to the connections and components within the metallic housing.

The prior art bases can require replacement of the various components following the weathering consequences.

Installation of the prior art bases requires prior mating of the component parts including checking of seals and tightening of threaded connections or screws which hold the detachable base plate in position. These threaded and screwed connections can also be susceptible to vehicle vibration in that they can work loose.

The present invention seeks to ameliorate these and other problems by providing an improved heavy duty aerial mounting base wherein an injection moulded housing rigidly holds the threaded connectors permanently in position.

It is an object of the present invention to provide an improved aerial mounting base which is weatherproof, eliminates corrosion of internal connections thereby protecting the integrity of signals and which has high structural resilience.

As a result of the moulded housing, the mounting base has a strength equal to or better than the prior art heavy duty bases and with a significant reduction in size.

Tests show that a dramatic improvement is achieved in the strength to weight ratio with use of the plastics moulding and also there is an elimination of corrosion within the housing.

The improved base is not made of detachable components as with the prior art. It is a one piece mounting base to which the various components are coupled such as the aerial itself and the radio cabling.

The improved moulding base material is structurally resilient, has greatly improved dielectric properties due to the inert material used as the housing. It has high stability and is not subject to the action of weathering.

Due to the efficient sealing of the connectors within the moulding the prospect of water ingress is eliminated. The need for rubber seals to waterproof joins in the base structure is eliminated.

Furthermore, corrosion from internal condensation which occurred within the hollow housings of the prior art bases is eliminated.

In the improved aerial mounting base of the present invention, there is no compromise to the overall structural integrity of the base with a high shock resistance and stress resistance being maintained despite the elimination of the traditionally strong metallic housing.

The embedding of the connectors in the moulded housing effectively isolates them from the actions of corrosion due to water or water vapour which previously was allowed to condense on the connectors and ensures efficient electrical separation of the connections from metallic or other interference due to the superior insulating properties of the moulding material.

The present invention also has the added advantage of economy and efficiency of manufacture.

In its broadest form the present invention comprises an improved heavy duty aerial mounting base comprising:

a structurally resilient moulded electrically insulating housing having at least a portion of a first member, a second member and a third member partially embedded rigidly therein in spaced apart relationship;

said first member being connected to said third member by means of a first wire embedded in said housing;

said second member being connected to said third member by means of a second wire embedded in said housing;

said first member being spatially and electrically separated from said second member;

each of said first, second and third members having a portion external to said housing which can be adapted to receive a mating member;

said housing electrically isolating said partially embedded portions and said first and second wires from outside interference;

said housing providing a weathershield.

In the preferred embodiment the moulding material used for the heavy duty aerial mounting base housing is a plastics material and provides a weatherproof shield for the components which are housed therein.

The housing is comprised of an inner core and an outer concentric core with a space therebetween reinforced with at least six spaced apart ribs. The number of ribs can be increased or reduced according to structural requirements.

In an alternative embodiment, the moulded insulating housing is comprised of a solid core such that the ribbing between the concentric cores is eliminated.

The said first and second members which are partially embedded in the housing each comprise a resilient shank having an anchoring flange at one end and are preferably disposed at 180°. The said third member is preferably disposed at 90° to the said first and second members and has an embedding stem.

The portions of the first, second and third members which are external to the housing are threaded to receive the respective mating members.

The invention will now be described by way of a preferred, but non-limiting, embodiment with reference to the accompanying illustrations, wherein:

FIG. 1 shows a heavy duty aerial mounting base 1 according to the preferred embodiment.

Figure 1:
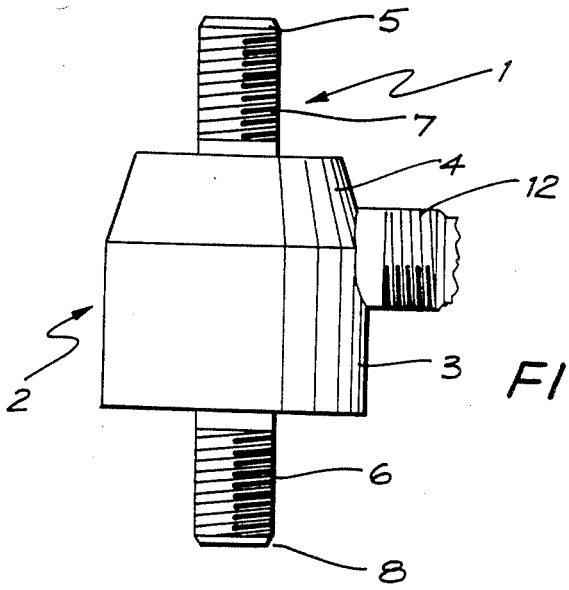
FIG. 1 shows the heavy duty mounting base according to the preferred embodiment of the present invention.

The base 1 is comprised of a resilient moulded housing 2 which has a first cylindrical portion 3 and a second frusto conical portion 4.

Within the housing there is partially embedded within an inner core 9 (see FIG. 2) two elongated members 5 and 6. These members are preferably disposed at 180° relative to each other. Each of members 5 and 6 have threaded portions 7 and 8 respectively which protrude outside the housing. These threaded portions are adapted to receive mating members (not shown).

Figure 2:
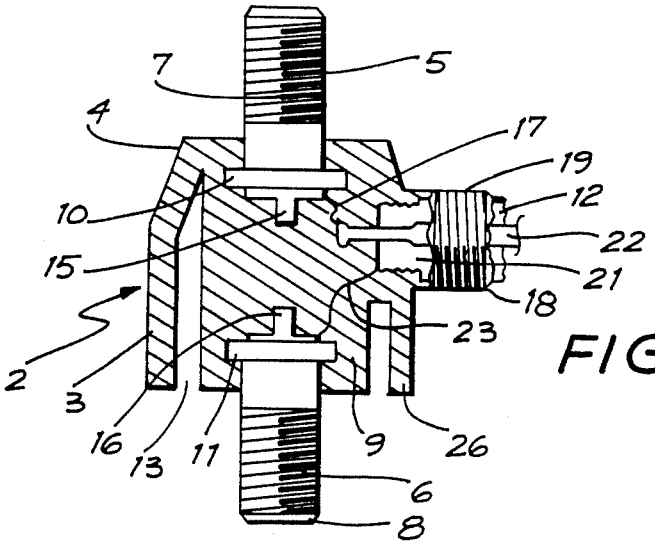
FIG. 2 shows a cross sectional view of the preferred embodiment of the invention.

As shown in FIG. 2, at the opposite end to the threaded portions 7 and 8, the members 5 and 6 have anchoring flange portions 10 and 11 respectively.

These flanges are wholly embedded within the inner core 9 and restrain members 5 and 6 from any tendancy to rotate, twist or pull out of the moulded housing.

A third member 12, which is disposed substantially normally to the members 5 and 6, is also partially embedded within the housing 2.

As can be seen from the cross sectional view in FIG. 2, the housing 2 is comprised of the inner core 9 and the concentric outer core 26. The inner core 9 is solid and therefore eliminates the void space which was present in the prior art heavy duty bases. The elimination of this void stops water in the form of liquid or moisture contacting the connections as the result of condensation or penetration through seals as has been the case with the prior art mounting bases. Between core 9 and core 26 there is an annular space 13 within which are placed reinforcing ribs 14 which strengthen the outer core 26.

Figure 3:
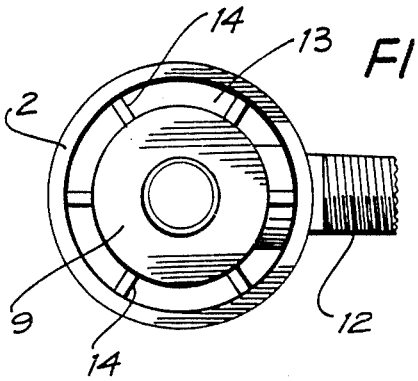
FIG. 3 shows an underside view of the heavy duty mounting base showing the reinforcing ribs according to a preferred embodiment.

The preferred but non limiting arrangement of reinforcing ribs 14 is shown in FIG. 3.

In an alternative embodiment (not shown) the housing is comprised of a single solid core and the ribs are eliminated.

First member 5 is elongated and protrudes vertically from the top of the housing 2 such that the threaded portion 7 is exposed. Connected normally to the flange 10 of member 5 is a stem 15 which is also embedded in the housing and which imparts lateral stability and resistance against over-turning to the member 5 when the aerial is mounted.

Also connected to the flange 10 or to another convenient position on member 5 is a conducting wire 17 which links the coaxial cable to the aerial via member 5.

Member 12 is comprised of an outer conductor 18 which has a first threaded portion 19 onto which the coaxial cable coupling (not shown) mates.

The outer conductor 18 has a second wider threaded portion 20 which embeds into the core 9 of housing 2.

Inside conductor 18 is an inner insulator 21 which electrically separates the outer conductor 18 from the coaxial cable conductor 22.

Connected to flange 11 or to another convenient position on member 6, is a stem 16 which imparts lateral stability to the housing 2.

Also connected to flange 11 is electrical cable 23 which acts in earthing conductor 18.

In use, member 6 is coupled with a known mounting base anchoring means (not shown).

Figure 4:
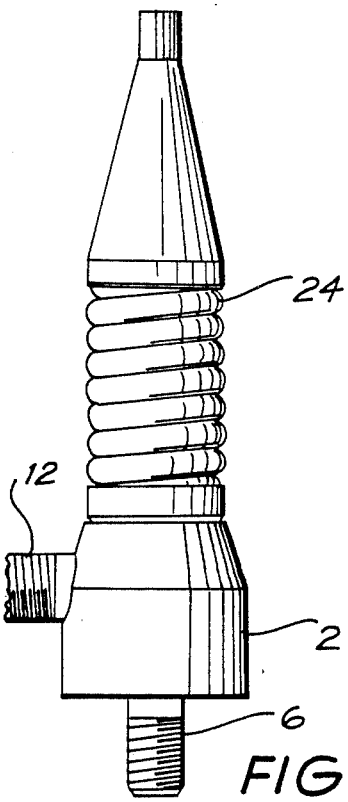
FIG. 4 shows an elevational view of the preferred embodiment with a spring loaded aerial connector.
Figure 5:
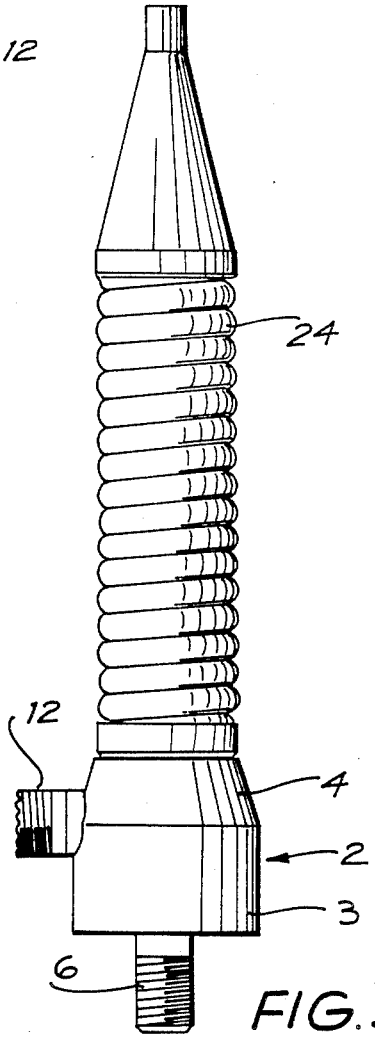
FIG. 5 shows an elevational view of the preferred embodiment of the present invention with an alternative spring loaded aerial connector.

Member 5 is adapted to mate with a spring loaded aerial mount 24 as shown in FIG. 4 or 5.

Figure 6:
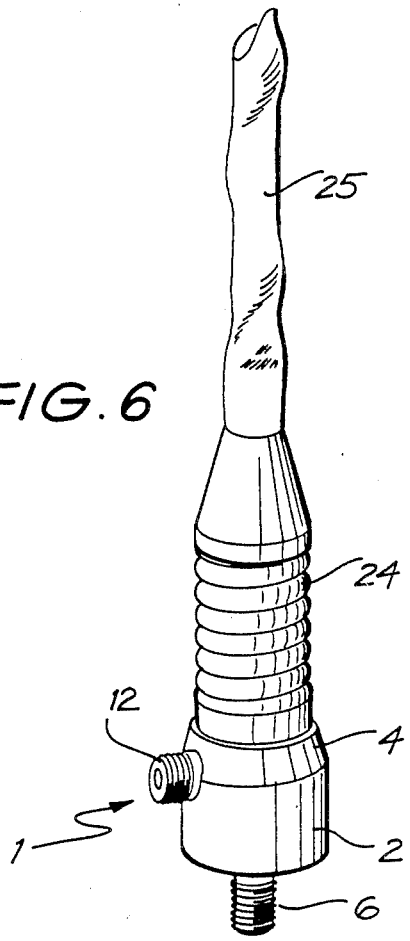
FIG. 6 shows an elevational view of the aerial mounting base with the aerial connected to the spring loaded aerial mount.

An aerial 25 is mounted on top of spring loaded mount 24 as shown in FIG. 6.

When the aerial mounting base is in position a coaxial cable (not shown) is coupled with member 12 thereby completing the installation.

According to the embodiment heretofor described the third member 12 is adapted with a threaded portion 19 onto which a coupling (not shown) mates.

The coupling which mates with third member 12 is the coaxial cable from the radio set for which an aerial is installed.

Figure 7:
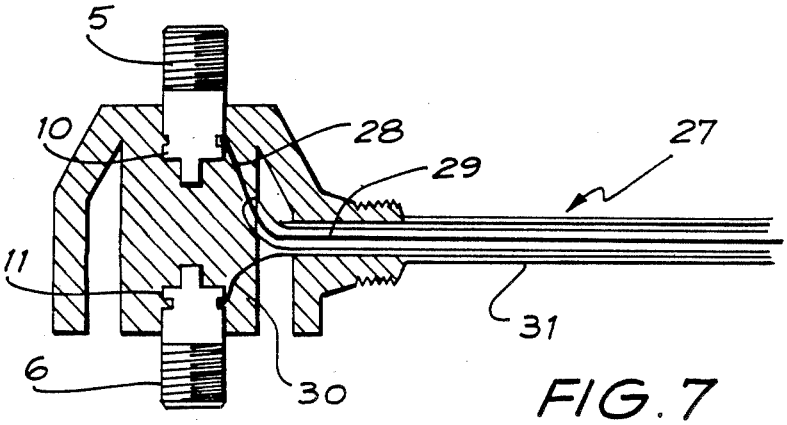
FIG. 7 shows a cross sectional elevational view of the aerial mounting base according to an alternative embodiment.

In an alternative embodiment as shown in FIG. 7, the mounting base is substantially the same as depicted in FIG. 1, however, in this embodiment the third member 12 is absent. The facility for the detachable coupling of the coaxial cable is eliminated. In this embodiment the coaxial cable is continuous until it terminates inside the housing and the mounting base is therefore permanently connected to the coaxial cable. The coaxial cable 27 has an inner conductor 28, an inner insulator 29, an outer conductor 30 and an outer insulator 31. In analogy with the first embodiment, the inner conductor 28 is interconnected at flange 10 to the first member 5. Also, the outer conductor 30 is connected to the flange 11 of second member 6.

In use, an aerial (not shown) is coupled with member 5. Member 6 is adapted to receive an anchoring means. No couplng of the coaxial cable 27 is necessary as it is permanently fixed in this embodiment of the moulded mounting base.

The resultant heavy duty aerial mounting bases provide a high strength to weight ratio alternative to the prior art mounting bases eliminating the disadvantages of corrosion within the base and assembly of a multiplicity of parts.

It will be recognised by persons skilled in the art that numerous variations and modifications may be made to the invention as described herein without departing from the overall spirit and scope of the invention.

I claim:

1. An improved heavy duty aerial mounting base comprising:

a structurally resilient molded electrically insulating housing having at least a portion of a first member, a second member and a third member partially embedded rigidly therein in spaced apart relationship;

said first member being connected to said third member by means of a first wire embedded in said housing;

said second member being connected to said third member by means of a second wire embedded in said housing;

said first member being spatially and electrically separated from said second member;

each of said first, second and third members having a portion external to said housing which can be adapted to receive a mating member;

said housing electrically isolating said partially embedded portions and said first and second wires from outside interference;

said third member being adapted with means to receive a coaxial cable;

said moulded insulating housing comprising a solid inner core and a weathershielding outer core formed integrally with the inner core;

the inner and outer cores being concentric with a space formed between said inner and outer cores, the outer core tapering inwardly and upwardly at one end of the said housing until it meets the inner core.

2. A mounting base according to claim 1, wherein the housing has reinforcing ribs disposed within the said space between the inner and outer cores to maintain a separation between said inner and outer cores to provide resistance to relative movement between said inner and outer core.

3. A mounting base according to claim 2, wherein the said first and second members both comprise an elongated shank with an anchoring means and are disposed at 180° relative to each other and are in axial alignment with the inner core and are embedded within the inner core.

4. A mounting base according to claim 2, wherein the said third member is an elongated shank and is disposed normally to said first and second members and is partially embedded within the inner core.

5. A mounting base according to claim 3, wherein the said third member is a coaxial cable which terminates inside the said housing.

6. A mounting base according to claim 1 wherein the said first, second and third members are each threaded to receive a mating member.

7. A mounting base according to claim 1, wherein the housing is formed of a solid core of resilient material.

* * * * *